United States Patent [19]

Kutik

[11] 4,079,865

[45] Mar. 21, 1978

[54] NON-PULSATING, NON-THROTTLING, VENTED PUMPING SYSTEM FOR CONTINUOUSLY DISPENSING PRODUCT

[75] Inventor: Louis F. Kutik, Fort Lauderdale, Fla.

[73] Assignee: John H. Oltman, Fort Lauderdale, Fla. ; a part interest

[21] Appl. No.: 659,227

[22] Filed: Feb. 19, 1976

[51] Int. Cl.[2] ..... B05B 11/02

[52] U.S. Cl. ..... 222/259; 222/321; 222/340; 222/385; 239/333; 417/541; 417/566

[58] Field of Search ..... 222/321, 340, 385, 257, 222/259, 260; 239/333; 417/541, 566

[56] References Cited

U.S. PATENT DOCUMENTS

| | | | |
|---|---|---|---|
| 2,980,343 | 4/1961 | Hays | 239/331 |
| 3,908,870 | 9/1975 | Nozawa | 222/321 |
| 3,921,861 | 11/1975 | Kondo | 222/340 X |
| 3,923,250 | 12/1975 | Boris | 222/321 X |
| 3,967,762 | 7/1976 | Machon | 222/321 |

*Primary Examiner*—Robert B. Reeves
*Assistant Examiner*—Frederick R. Handren
*Attorney, Agent, or Firm*—Oltman and Flynn

[57] ABSTRACT

A non-pulsating, non-throttling, vented pumping system is disclosed for continuously dispensing product from a container in a relatively non-pulsating stream or spray. The pumping system includes a pump for withdrawing product from a container and for pressurizing the product, a storage compartment for storing the product under pressure, an accumulator piston in the storage compartment acting under bias to maintain the pressure on the product, an outlet passage opened and closed by the accumulator piston, and a restricted orifice at the outlet passage through which the product is dispensed as a stream or spray. The restricted orifice allows only a portion of the product pressurized by the pump to escape during the pressure stroke of the pump, and the remainder of the product is stored in the product storage compartment to be released for maintaining the spray or stream when the pressurizing pump is acting on its intake stroke. The accumulator piston shuts off the outlet passage when the pump is at rest in a manner such that the pump is non-throttling. The container is vented to the atmosphere through the pump. The pressurizing pump's actuator has a relatively short stroke and so can be pumped rapidly such that the stream or spray need not be maintained by the accumulator piston for a long time on a given intake stroke.

15 Claims, 10 Drawing Figures

NON-PULSATING, NON-THROTTLING, VENTED PUMPING SYSTEM FOR CONTINUOUSLY DISPENSING PRODUCT

BACKGROUND OF THE INVENTION

Dispensing pumps in use at the present time ordinarily dispense products in a pulsating stream or spray. Typically, the product emerges from the pump in spurts. In many applications, it would be more desirable to dispense product with a pump in a continuous, relatively non-pulsating stream or spray. In addition, the pumping device should have provisions for venting the container to the atmosphere without allowing escape of product through the vent when the pump is not in use, and should also have provisions for preventing escape of product when the container is squeezed, particularly if the container is made of a yieldable plastic.

SUMMARY OF THE INVENTION

This invention relates to a product pumping system that dispenses product from a container in a relatively continuous, non-pulsating stream or spray. The stream is relatively free from pulsations even when the pressurizing pump of the system is on its intake stroke. In addition to a pressurizing pump, this system includes a storage compartment for storing product dispensed from the pump under pressure, an accumulator piston in the storage compartment acting under bias to maintain the pressure on the product, an outlet passage opened and closed by the accumulator piston, and a restricted outlet orifice at the outlet passageway through which the product is dispensed in a continuous stream or spray. In preferred embodiments, the pumping system includes a vent which is normally closed to prevent escape of product, but which vents the container to the atmosphere during the pumping action. The embodiments disclosed herein include provisions for preventing escape of product when the container is squeezed if the container is compressible. This shut off feature makes the pump non-throttling.

Accordingly, it is an object of the present invention to provide a pumping system for dispensing a product from a container in a steady stream or spray.

Another object of the invention is to provide a pumping system that has a compartment for storing a quantity of pressurized product under pressure such that the product can be released through a restricted orifice when the pressurizing pump of the system is on its intake stroke.

Another object of this invention is to maintain a more equalized pressure on the product being dispensed from a pump than is obtainable with known pumps.

Another object of the invention is to provide a pumping system which will not dispense product at the beginning of the pressurizing stroke of the pump included in the system.

Another object of the invention is to provide a pumping system that will not dispense product under the low pressure existing at the end of the exhaust stroke of a pump included in the system.

Another object of the invention is to provide a pumping system that has a vent to allow air to enter the container to overcome the suction caused when the pump of the system removes some of the product.

Another object of the invention is to provide a pump with a vent that is closed when the pump is at rest, thereby eliminating the accidental ejection of product by pressure on the container if the container is flexible.

Further objects and advantages of this invention will be apparent from the following detailed description of a presently-preferred embodiment thereof, which is shown in the accompanying drawings.

Figure 1:
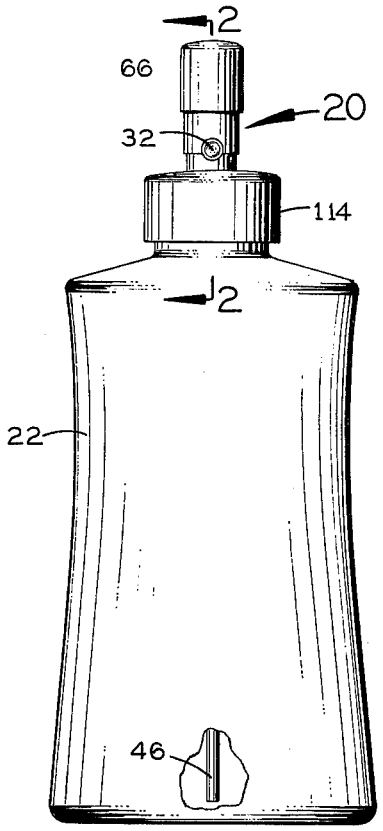
FIG. 1 is an elevational view of a container provided with a pumping system in accordance with one embodiment of the invention.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Referring first to FIGS. 1 through 6, the pumping system 20 serves to dispense product from a container 22. The product is dispensed as a stream or a spray. The action of the pump in system 20 is such that the product is dispensed as a relatively steady stream or spray; i.e., it is a relatively nonpulsating stream or spray.

The pumping system 20 includes a pressuring pump designated generally as 24. In the embodiment shown in FIGS. 1 through 6, the pump 24 is of the type described and claimed in U.S. Pat. No. 3,507,586 of Louis F. Kutik and Erich G. Gronemeyer.

The pumping system 20 also includes a circular storage compartment 26 for storing the product dispensed from the pump 24 under pressure, an annular accumulator piston 28 in the storage compartment and under bias to maintain the pressure of the stored product, an outlet passageway 30 leading from the storage compartment which is opened and closed by the accumulator piston 28, and a restricted orifice 32 in communication with the outlet passageway 30. As previously mentioned, the orifice 32 is restricted sufficiently to allow only a portion of the product pressurized by a given pressurizing stroke of the pump 24 to exhaust through the orifice, the remainder of the pressurized product being stored in the storage compartment 26 due to expansion of that compartment by downward movement of the accumulator piston 28, so that the stored product continues to be released as a stream or spray when the pressurizing pump 24 is on its intake stroke. The actuator 64 of pump 24 has a relatively short stroke and can be reciprocated rapidly, such that the stream or spray need not be maintained by the accumulator piston for a long time on a given stroke.

The pumping system 20 includes a pump body 34 which has an upper annular portion 36 and a lower annular portion 38. Inside the lower annular portion 38, there is an upstanding tubular portion 40 of the pump body 34 which has a longitudinal bore 42 forming an eduction passageway. Attached to the lower end of the lower portion 38 of the valve body 34, there is a retainer tube portion 44 which receives and holds a dip tube 46. The dip tube 46 extends down into the container 22 as shown in FIG. 1, and the product in the container is sucked up through the dip tube 46 into the pumping system 20.

The tubular portion 40 of the pump body 34 has an upper end 48 which forms with a ball 50 an inlet valve. The inlet valve 48, 50 is part of the pump designated generally 24.

Mounted on top of the tubular portion 40, there is valve member 52 having a resilient, yieldable, flap 54 with a circular sealing edge 56. The flap 54 and circular sealing edge 56 form an exhaust valve for the pump 24. The edge 56 is biased against the surrounding wall of member 58 as described in U.S. Pat. No. 3,507,586.

Mounted on top of the valve member 52, there is a pressure developing cylinder 58. The pressure developing cylinder has circumferentially spaced projections 60 engaging the top of the valve member 52 so as to allow pressurized product to escape past the flat 54 of the member 52. The pressure developing cylinder 58 is an annular, hollow member which has inside the same a pressure developing compartment 62. Received on the pressure developing cylinder 58, there is an actuator 64. In this embodiment, the actuator 64 is a piston, but is should be understood that the actuator 64 may be a diaphragm if desired. The actuator 64 is adapted to ride up and down on the outside of the pump body 34 since it has a depending annular portion 66 slidably engaging the outside of the pump body 34 at 68.

The upper portion 36 of the pump body 34 has a circular riveted portion 70 which engages a circular shoulder 72 on the actuator 64 to keep the actuator from sliding off the pump body. The actuator 64 is biased upwardly by a coil spring 74, the upper end of which engages the top 76 of the actuator, and the lower end of which engages the shoulder 78 of the pressure developing cylinder 58.

The pump body 24 has a riveted portion 80 which overlaps and holds the shoulder portion 78 of the pressure developing cylinder 58 down on the valve member 52.

The lower end 82 of the pressure developing cylinder 58 is spaced slightly from a projection 84 on the valve body 24 so as to form the outlet passageway 30. The pump body 24 has a circular hollow projection 86 which receives a nozzle 88 in which the restricted orifice 32 is formed. The spray nozzle 88 is shown more clearly in FIG. 6. It has a groove 90 all around one face thereof, and the projection 92 has slots 94 and 96 leading to the restricted orifice 32 which extends all the way through the nozzle 88.

Inside the pump body 24 and the pressure developing cylinder 58, under the valve member 52, there is a storage compartment 26. This storage compartment receives pressurized product when it is forced past the flat 54 of valve member 52 by depression of the actuator 64. The valve member 52 acts as a check valve to prevent pressurized product from flowing in reverse out of the storage compartment back toward the intake valve on an intake stroke of the pump.

In the storage compartment 26, there is the accumulator piston 28. The accumulator piston 28 has a circular, yieldable flap 98 which engages and is biased against the adjoining wall of the pump body 34. The accumulator piston 28 is slidable up and down along the inside cylindrical surface of the pump body 34 at 100. The flap 98 extends upwardly. There is another flap 102 which is part of the accumulator piston 100 and which extends downwardly from the main body from the accumulator piston 100. The flap 102 is a resilient member slidably engaging and biased against the inner wall 100 of the valve body 34.

Just above the lower end of the flap 102, there is a vent opening 104 which extends through the pump body 34 so as to allow air from the outside atmosphere to enter the container when the accumulator piston 28 is depressed. The lower portion 38 of the pump body 34 has spaced ribs or projections 106 on which the flap 102 rides when the accumulator piston is depressed. When the flap 102 rides on the projections 106, air can enter through the space 108 and the vent 104 between the projections 106 and another vent opening 110 through the valve body portion 38 into the container 22.

The accumulator piston 28 is biased upwardly by a coil spring 112, the lower end of which engages the lower portion 38 of the pump body 34 and the upper end of which engages the main body of the accumulator piston 28. The container 22 is closed by a closure member 114 which has an interior threaded finish 116. The closure member 114 has an internal annular portion 117 forming a bore in which the pump body 34 is received. The pump body 34 has a shoulder at 118 which rests on a corresponding shoulder of the annular portion 116.

Figure 2:
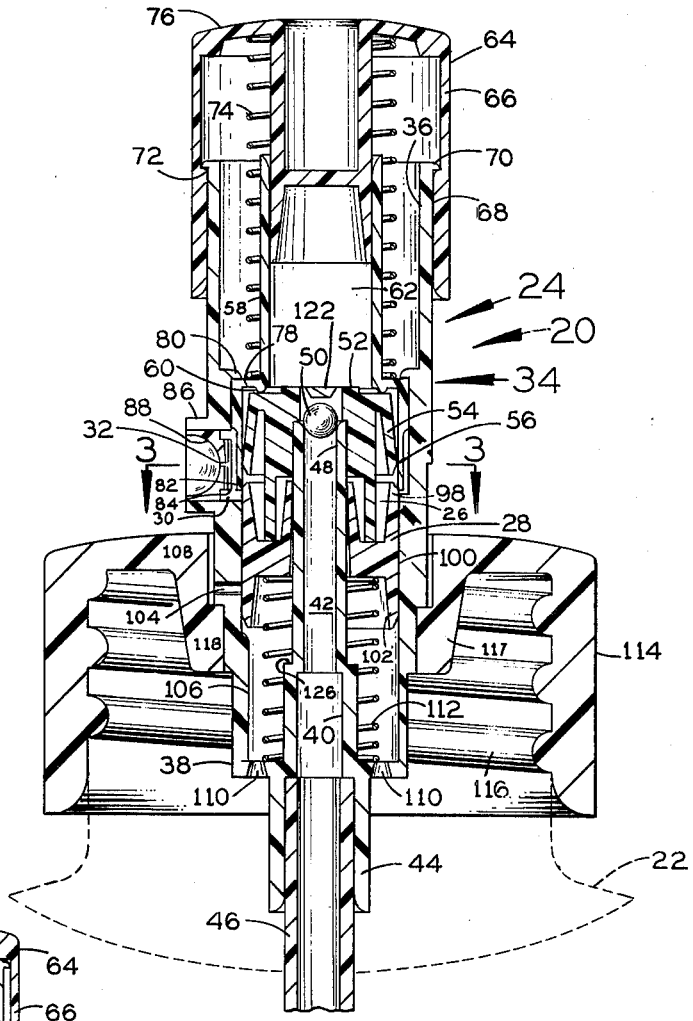
FIG. 2 is a vertical sectional view of the pumping system taken along line 2—2 of FIG. 1 and looking in the direction of the arrows.
Figure 4:
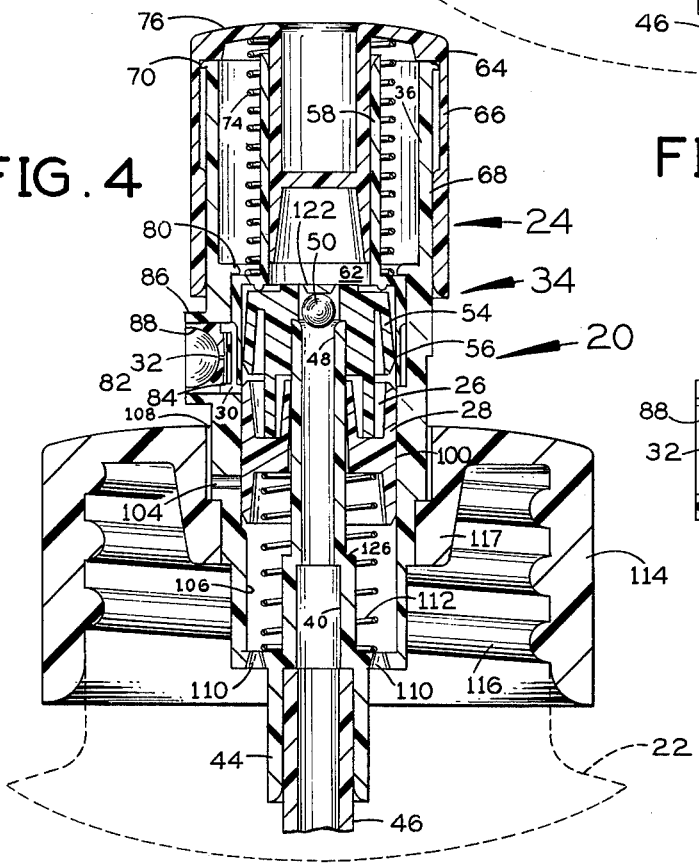
FIG. 4 is a vertical sectional view similar to FIG. 2, but showing the actuator of the pumping system in a depressed condition as it would appear on the initial priming stroke of the pumping system.
Figure 3:
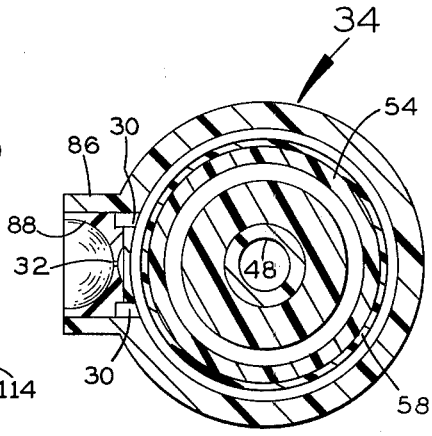
FIG. 3 is a cross-sectional view of the pumping system taken along line 3—3 of FIG. 2 and looking in the direction of the arrows.

The pumping system 20 is shown in a rest condition in FIG. 2. In FIG. 4, the priming stroke of the pump 24 is shown. The actuator 64 has been depressed. The actuator 64 has started its exhaust stroke in which it moves upward. The ball 50 has moved upwardly off the upper end of the tubular portion 40 of the valve body 34. Product is being sucked through the dip tube 46 and the tubular portion 40 past the intake ball valve 50 into the pressurizing compartment 62.

Figure 5:
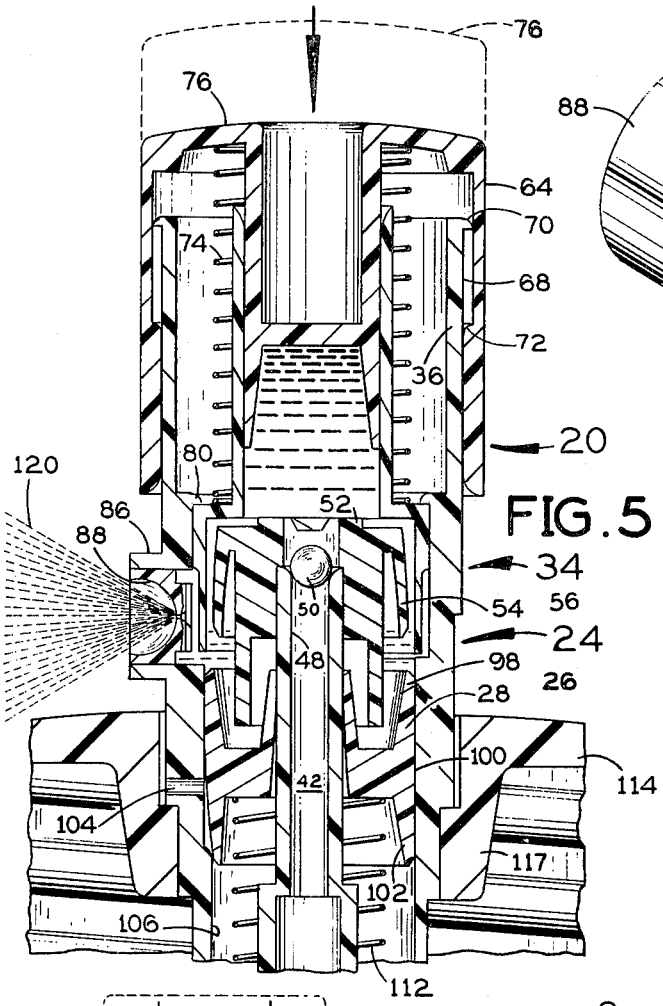
FIG. 5 is a vertical sectional view similar to FIG. 2, but showing the actuator of the pumping system depressed as it would appear during the pressurizing stroke of a pump included in the system.
Figure 6:
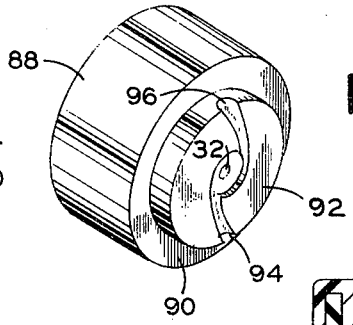
FIG. 6 is a perspective view of a spray nozzle with restricted orifice included in the pumping system of FIGS. 1-5.

FIG. 5 shows the exhaust stroke or pressurizing stroke of the pump 24. The pressurizing compartment 62 is full of product. The actuator 64 is being depressed. The depression of the actuator 64 forces product past the flap 54 of the exhaust valve member 52 into the storage compartment 26. The storage compartment 26 fills up and forces the accumulator piston 28 downwardly against the bias of the spring 112. As the accumulator piston moves downwardly, it opens the outlet passage 30. As soon as the outlet passage opens, pressurized product starts to flow through the outlet passage 30 and also through the restricted orifice 32 producing the spray 120. It will be understood that the product may be dispensed as either a stream or a spray as desired. The orifice 32 is restricted sufficiently to allow only a portion of the product pressurized by a compression stroke of the actuator 64 to exhaust through the orifice. The rest of the pressurized product is stored in the storage compartment to be released so as to maintain the spray or stream when the pressurizing pump is on its next intake stroke. In this manner, a continuous spray or stream of product is provided; i.e., it is a non-pulsating stream or spray. Note that there is a member 122 which is a portion of the valve member 52 located just above the ball 50 so as to keep that ball from moving too far upwardly. The member 122 has spaces around its periphery to allow the product to flow past that member.

When the user stops pressurizing the pump, the accumulator piston 28 eventually moves back upwardly to close the outlet passageway 30. This positive closing of the outlet passageway prevents dribbling of the product from the pump. At the beginning of the pressurizing action, no product is dispensed until the resistance of spring 112 is overcome and accumulator piston 28 moves down enough to open outlet passageway 30. At the end of the action, no product is dispensed after piston 28 closes passageway 30.

The flap 102 prevents products from reaching the vent orifice 104 even if the container is squeezed assuming that the container is a flexible container. The accumulator piston 28 is stopped in its downward stroke by a shoulder 126 on the tubular portion 40. When the accumulator piston 28 is depressed as far as the shoulder 126, the upper sealing edge 98 of that accumulator piston is still above the vent orifice 104 so that product does not escape from the vent orifice.

FIGS. 7 through 10 show another embodiment of the invention. There is a container 200 provided with a pumping system 202 for dispensing product from the container 200 in a continuous stream or spray. The pumping system 202 is shown in more detail in FIG. 8. There is a pump body 204 which is a hollow tubular member having a downwardly projecting tubular portion 206 on which a dip tube 208 is received. The pump body 204 includes an inner upwardly extending tubular portion 210 in which an intake ball valve 212 is received at the top. The ball rests on shoulder 213 and is covered by apertured cover 215.

The second tubular member 214 is received inside the pump body 204. The tubular member 214 is in the nature of a piston, and it contains an exhaust ball valve 216. Ball 216 rests on shoulder 217 and is covered by apertured cover 219. The tubular member 214 has a flange 218 that rides on the outside of the pump body 204. Inside the tubular member 204 there is a pressurizing compartment 220. Above the pressurizing compartment 220 there is an accumulator piston 222 in a storage compartment 223. The accumulator piston 222 is biased downwardly by a coil spring 224. The tubular member 214 includes an upper portion 226 on which a cap 228 is received. The cap 228 fits tightly on the member 214.

The member 214 is biased upwardly by another coil spring 230 which is received inside the pump body 204.

The accumulator piston member 222 has a circular sealing edge 232 at the end of an annular flap 234. The flap 234 is a little larger than the body 214 so that the edge 232 is biased against the body 214. This prevents product from escaping past the piston 222.

A nozzle 236 is held in a projection 238 extending outward from the tubular member 214. The nozzle 236 has a restricted orifice 240 which is in communication with an outlet passageway 242 located just above the edge 232 when the accumulator piston 222 is in its downward rest position. The accumulator piston 222 rests on a shoulder 244 in its downward position.

The pump body 204 is received in a closure 250 which has interior threads 252 for attachment to the threads of a container.

Figure 8:
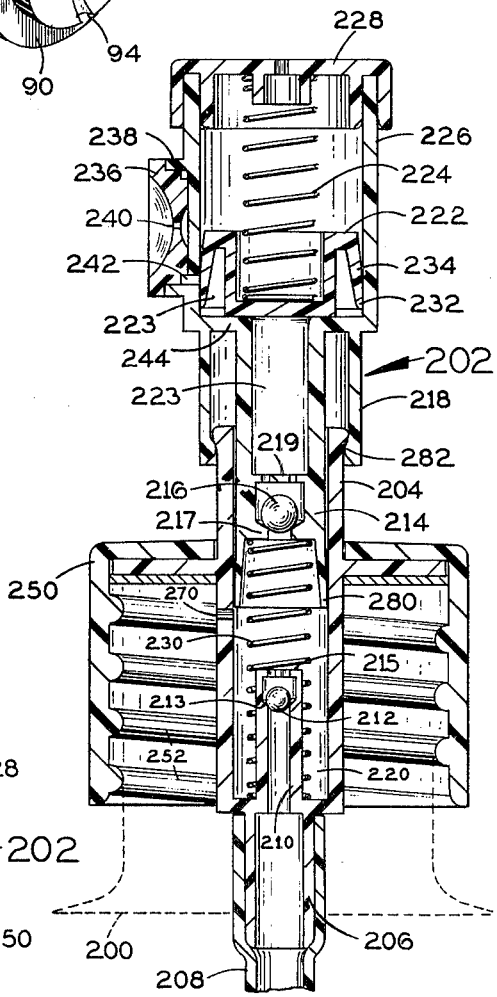
FIG. 8 is a vertical sectional view taken along line 8—8 of FIG. 7 and looking in the direction of the arrows.

The pumping system 202 is shown in its rest condition in FIG. 8. On the initial priming stroke of the pump which is not shown, product is sucked through the dip tube 208 and the inlet valve 212 and exhaust valve 216 into the pressurizing compartment 220.

Figure 9:
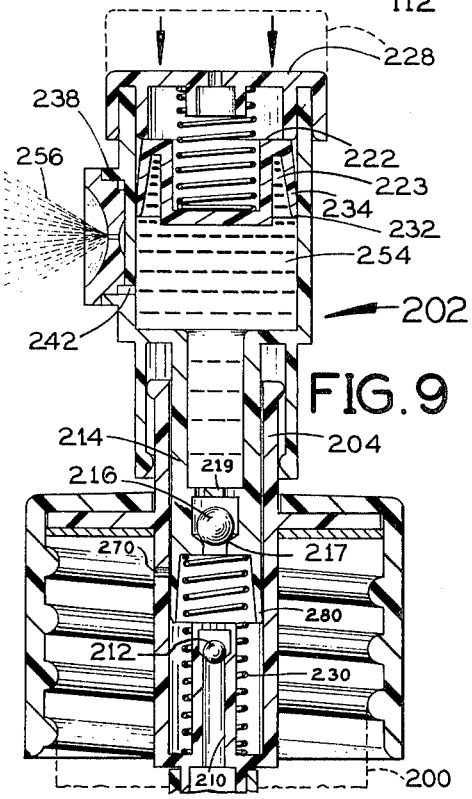
FIG. 9 is a vertical sectional view similar to FIG. 8, but showing an actuator of the pumping system in a depressed condition as it would appear when product is being dispensed from the system.
Figure 7:
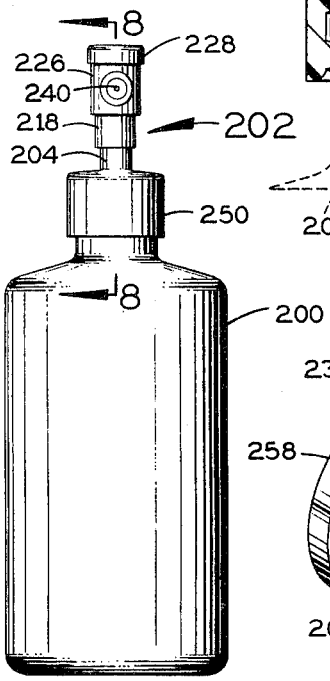
FIG. 7 is an elevational view of a container provided with a pumping system in accordance with another embodiment of the invention.

The pressurizing stroke of the piston member 226 is shown in FIG. 9. The accumulator piston 222 rides upwardly inside the member 214 so that product is stored in the storage compartments 223 and 254. Part of the product is dispensed through the restricted orifice 240, but some of the product remains in the storage compartment after the pressure stroke of the member 214. This product escapes during the next intake stroke of the piston member 214 so as to provide a substantially continuous stream or spray 256.

Figure 10:
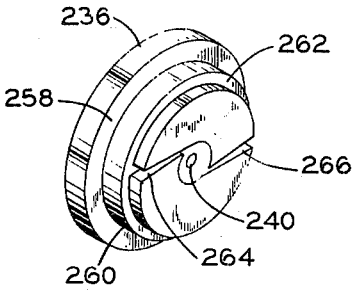
FIG. 10 is a perspective view of a spray nozzle with restricted orifice included in the pumping system of FIGS. 7-9.

The nozzle 236 is shown in more detail in FIG. 10. It has a groove 258 around its perimeter, and a projection 260 projecting from the groove. A second groove 262 is formed in the projection 260. The restricted orifice 240 communicates with the groove 262 through slots 264 and 266. The groove 262 communicates with the outlet passage 242 so that product may be dispensed from the storage compartment 254 through the outlet passage 242, the groove 262, and the restricted orifice 240.

The pump body 204 includes a vent opening 270 through which air can enter into the container 200. The vent opening leads into the inside of the pump body 204 from the container. The lower end of the member 214 has a resilient flap 280, resiliently engaging the inside surface of the pump body 204. The connection between the piston member 214 and the pump body 204 at the lower end of the flange 218 as shown at 282 is a relatively loose connection so that air can enter past this connection. When the actuator is depressed, the air can flow down between the member 214 and the pump body 204 and through the vent orifice 270 into the container. When the actuator is being depressed, the portion 280 goes downwardly past the vent orifice 270 so that venting is accomplished.

With the actuator in its rest condition, if the container is squeezed, and if the container is a flexible container, product would be forced past the intake valve 212. The pumping system as shown in FIGS. 7 through 10 prevents product from escaping from the restricted orifice 240 if the container is squeezed because piston 222 shuts off outlet passage 242.

It will be understood that the pump may be a finger actuated type, a lever actuated type, or hand actuated type.

Having thus described my invention, I claim:

1. A pumping system for dispensing a product, including in combination: a container for product, a dip tube, a manually actuated pressurizing pump for pressurizing product received from said container through said dip tube, a storage compartment for storing the pressurized product from the pump, a restricted outlet for discharging the pressurized product, and a means to vent the container, said storage compartment being in the form of a cylinder, said storage compartment including an accumulator piston reciprocable as said pressurizing pump pumps product into said storage compartment, and said means to vent the container including means on the wall of said cylinder for breaking the seal of said accumulator piston for allowing the inside of said container to maintain atmospheric pressure.

2. The pumping system as claimed in claim 1 wherein said restricted outlet is restricted sufficiently to control the rate of product discharge therethrough so as to cause a portion of the product to be stored in said storage compartment during a pressure stroke of said pump when pumping continuously to be discharged through said orifice on an intake stroke of said pump.

3. The pumping system as claimed in claim 2 wherein said storage compartment is located between said pressurizing pump and said restricted orifice.

4. The pumping system as claimed in claim 1 wherein said pressurizing pump has an intake valve and an exhaust valve, said intake valve allowing the product to enter the pump from the container, and said exhaust valve allowing product to enter the storage compartment, said exhaust valve also acting as a check valve to restrict a reverse flow of the product when said pressuring pump is on its intake stroke.

5. A pumping system for pumping product from a container in a relatively continuous stream or spray, including in combination:

a pressurizing pump including first and second check valves and a first spring-loaded piston and cylinder assembly for withdrawing a quantity of product from the container through said first check valve during an intake stroke and for pressurizing said quantity of product during a pressurizing stroke, storage compartment means including a second spring-loaded piston and cylinder assembly expandable for storing under a pressure determined by said second spring-loaded assembly, a quantity of pressurized product received through said second check valve from said pressurizing pump, a restricted outlet orifice, said storage compartment means being functionally located with said restricted outlet orifice at its outlet and said second check valve at its inlet from said pressurizing pump, said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke, said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice.

6. A pumping system as claimed in claim 5 wherein said second spring loaded piston of said storage compartment means normally blocks flow of product to said orifice and is movable to expand said storage compartment means and pass flow of product to said orifice.

7. A manually actuated dispenser pumping system for dispensing product from a container, comprising:

manually actuated pressurizing pump means having a pumping cylinder and piston which moves in a first direction during an intake stroke and in an opposite second direction during a pressurizing stroke for pressurizing product withdrawn from the container by said pump means;

storage compartment means in communication with said pump means for storing pressurized product delivered from said pump means;

accumulator piston means under bias in said storage compartment means and movable by the pressure of the product to expand the capacity of said storage compartment means;

restricted orifice means in communication with said storage compartment means and restricted sufficiently to control the rate of product discharge therethrough so as to cause a portion of the product to be stored in said storage compartment during a pressurizing stroke of said piston of said pump means when pumping continuously to be discharged through said orifice on an intake stroke of said pump means, said accumulator piston means controlling the opening and closing of said restricted orifice means;

vent means for venting said container to the atmosphere;

said pump means having an intake valve and an exhaust valve, said intake valve allowing the product to enter said pump means from the container, and said exhaust valve allowing the product to enter said storage compartment means;

said exhaust valve being located between said storage compartment means and said intake valve and serving to block any reverse flow of product from said storage compartment means on said intake stroke;

said accumulator piston means acting to shut off said restricted orifice means in the rest condition of said pump means; and said piston of said pump means acting to shut off said vent means in the rest condition of said pump means and to open said vent means on the pressurizing stroke of said pump means.

8. In a manually operated pumping system for dispensing a fluent product from a container in a substantially non-pulsating discharge, said system having mounting means for attaching it to the container and comprising:

means providing a pressurizing compartment for receiving product from the container;

manually reciprocable actuator means movable in one direction in an intake stroke to withdraw product from the container into said pressurizing compartment and movable in the opposite direction in a pressure stroke to pressurize the product in said pressurizing compartment;

means providing a storage compartment for receiving pressurized product from said pressurizing compartment upon said movement of said actuator means in its pressure stroke;

and an outlet passageway leading from said storage compartment for dispensing pressurized product therefrom;

the improvement which comprises the combination of:

an accumulator piston slidably reciprocable in said storage compartment and operable to open and close said outlet passageway, spring means biasing said piston to a position closing said outlet passageway, said piston being movable by the pressure of product in said storage compartment against the bias of said spring means to open said outlet passageway;

and a check valve acting between said pressurizing compartment and said storage compartment, said check valve being operative to pass pressurized product from said pressurizing compartment into said storage compartment for moving said piston to open said outlet passageway upon movement of said actuator means in its pressure stroke, said check valve being operative to block return flow of product from said storage compartment back into said pressurizing compartment upon the following intake stroke of said actuator means whereby to maintain the dispensing of product through said outlet passageway as long as the pressure of product in said storage compartment maintains said piston positioned to open said outlet passageway;

said outlet passageway intersecting said storage compartment transverse to the path of movement of said piston therein, and said piston in its closing position directly sealingly engaging around the intersection of said outlet passageway with said storage compartment.

9. A pumping system according to claim 8, and further comprising means defining a restricted discharge orifice connected to said outlet passageway to receive pressurized product therefrom and effective to restrict the flow of pressurized product through said outlet passageway and establish back pressure thereat which enhances the pressure of product in said storage compartment for maintaining said piston positioned to keep said outlet passageway open after the completion of the pressure stroke of said actuator means.

10. A pumping system according to claim 9, and further comprising means for limiting said movement of said actuator means to short pressure and intake strokes, whereby said actuator means is manually reciprocable rapidly to maintain a substantially continuous discharge of product from said discharge orifice during successive pressure and intake strokes of said actuator means.

11. A pumping system according to claim 10, wherein: said pressurizing compartment is above said storage compartment;

and said check valve is located below said pressurizing compartment and has a depending, annular, resilient flap which is biased into sealing engagement with the wall of said storage compartment above the intersection of said outlet passageway therewith, said flap being yieldable by the pressure of product in said pressurizing compartment to disengage from said storage compartment wall and pass product from the pressurizing compartment down into the storage compartment.

12. A pumping system according to claim 11, wherein:

said means providing the storage compartment is an annular body slidably receiving said accumulator piston and having a vent opening therein communicating with the atmosphere and spaced below the intersection of the outlet passageway with the storage compartment;

said accumulator piston having a depending, flexible, resilient, annular flap which closes said vent opening when the piston closes said outlet passageway;

said annular body having spaced internal ribs for deflecting said depending flap on the piston inwardly to open said vent opening when the piston opens said outlet passageway;

and said annular body having openings below said ribs which communicate with the interior of the container for connecting the interior of the container to the atmosphere through the spaces between said ribs at the outside of said depending flap on the piston and said vent opening.

13. A pumping system according to claim 10, wherein:

said pressurizing compartment is below said storage compartment;

and said check valve comprises an upwardly-facing valve seat between said pressurizing and storage compartments, and a ball valve which normally seats on said valve seat by gravity and is upwardly displaceable by pressurized product in said pressurizing compartment during said pressure stroke of said actuator means to unseat from said valve seat and pass product up from the pressurizing compartment into the storage compartment.

14. A pumping system according to claim 13, and further comprising:

an inner tubular body carrying said valve seat and operatively connected to said actuator means to reciprocate with the latter;

an outer tubular body slidably receiving said inner tubular body and having a vent opening therein which communicates with the interior of the container;

said inner tubular body at its lower end sealingly engaging the inside of said outer tubular body above said vent opening when said actuator means is at its limit of movement in its intake stroke;

and said outer and inner tubular bodies providing a vent passageway between them above said lower end of the inner tubular body which communicates with said vent opening and the atmosphere, whereby to connect the interior of the container to the atmosphere, during said pressure stroke of said actuator means.

15. A pumping system for dispensing a product, including in combination: a container for product, a housing, a dip tube affixed to said housing, a manually actuated pressurizing pump for pressurizing product received from said container through said dip tube, said pump including a movable pump piston, a storage compartment for storing the pressurized product from the pump, means forming a flow path between said pump and said storage compartment, a one-way check valve disposed in said flow path, a restricted outlet for discharging the pressurized product from said storage compartment, and a means to vent the container, said storage compartment being in the form of a cylinder, said storage compartment including an accumulator piston reciprocable in said cylinder as said product is pumped for storing a portion of the product for at least a full cycle of operation of said pump when pumping continuously to be discharged through said outlet on an intake stroke of said pump, said cylinder being fixed to said pump piston and reciprocable in said housing for operating said pump and having a rest position, and said means for venting the container including an opening in said housing and seal means on said pump piston for blocking said opening in the rest position of said cylinder and unblocking the opening as said cylinder reciprocates to vent the container to the atmosphere.

* * * * *